US009450317B2

(12) United States Patent
Son et al.

(10) Patent No.: US 9,450,317 B2
(45) Date of Patent: Sep. 20, 2016

(54) CONNECTOR OF ELECTRONIC DEVICE AND ELECTRONIC DEVICE HAVING THE SAME

(71) Applicant: Samsung Electronics Co., Ltd., Gyeonggi-do (KR)

(72) Inventors: Dongil Son, Gyeonggi-do (KR); Kyuwon Choi, Gyeonggi-do (KR); Jongchul Choi, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 0 days.

(21) Appl. No.: 14/204,029

(22) Filed: Mar. 11, 2014

(65) Prior Publication Data

US 2014/0287603 A1 Sep. 25, 2014

(30) Foreign Application Priority Data

Mar. 25, 2013 (KR) ..... 10-2013-0031604

(51) Int. Cl.
*H01R 12/70* (2011.01)
*H01R 12/71* (2011.01)
*H01R 13/24* (2006.01)

(52) U.S. Cl.
CPC ..... *H01R 12/7088* (2013.01); *H01R 12/716* (2013.01); *H01R 13/24* (2013.01)

(58) Field of Classification Search
USPC ..... 439/862, 733.1, 188, 916, 81, 500, 638, 439/607.4
See application file for complete search history.

(56) References Cited

U.S. PATENT DOCUMENTS

| | | | | |
|---|---|---|---|---|
| 5,885,090 | A * | 3/1999 | Comstock et al. | 439/65 |
| 6,077,130 | A * | 6/2000 | Hughes et al. | 439/862 |
| 6,302,727 | B1 * | 10/2001 | Fedorjaka | 439/500 |
| 6,875,049 | B2 * | 4/2005 | Kyowski et al. | 439/500 |
| 6,994,576 | B2 * | 2/2006 | Tanaka et al. | 439/188 |
| 7,258,571 | B1 * | 8/2007 | Chen | 439/500 |
| 7,278,892 | B1 * | 10/2007 | Chien et al. | 439/862 |
| 7,549,869 | B1 * | 6/2009 | Chiang et al. | 439/65 |
| 7,575,469 | B1 * | 8/2009 | Hung | 439/500 |
| 7,955,146 | B1 * | 6/2011 | Wang et al. | 439/862 |
| 8,033,870 | B2 * | 10/2011 | Xie | 439/660 |
| 2005/0221632 | A1 * | 10/2005 | Sun et al. | 439/65 |
| 2008/0119138 | A1 * | 5/2008 | Kim et al. | 455/41.2 |
| 2012/0156903 | A1 * | 6/2012 | Kim | 439/81 |

FOREIGN PATENT DOCUMENTS

KR 10-0960959 B1 5/2010

* cited by examiner

*Primary Examiner* — Alexander Gilman
(74) *Attorney, Agent, or Firm* — Cha & Reiter, LLC.

(57) ABSTRACT

A connector of an electronic device and an electronic device having the same are provided. The connector of an electronic device may includes a mold fixed on a main board of the electronic device; a first connection pin having a first connecting portion protruded to one surface of the mold; and a second connecting portion separated from the mold and an extension that connects the second connecting portion and the mold.

20 Claims, 8 Drawing Sheets

CONNECTOR OF ELECTRONIC DEVICE AND ELECTRONIC DEVICE HAVING THE SAME

CLAIM OF PRIORITY

This application claims the benefit under 35 U.S.C. §119 (a) of a Korean patent application filed on Mar. 25, 2013 in the Korean Intellectual Property Office and assigned Serial No. 10-2013-0031604, the entire disclosure of which is hereby incorporated by reference.

BACKGROUND

1. Technical Field

The present disclosure relates generally to an electronic device and more particularly to a connector of an electronic device and an electronic device having the same.

2. Description of the Related Art

Recent electronic devices, such as smart phones, perform complicated functions such as photographing a picture or recording a moving picture, reproducing a music file or a moving picture file, playing a game, receiving a broadcast, and providing wireless Internet support. Such functions are often embodied in a multimedia player form. Integrating these many and varied functions into a single device in a multimedia format have necessitated development of both hardware and software that support such functions. For example, some recent electronic devices include a connector that can connect external devices to the electronic device. Such external devices include antennas to provide multimedia functions and battery chargers (e.g., wireless or or solar chargers) to power the device and recharge the battery.

A connecting portion of the connector is exposed through one surface of an electronic device body at a location dependent upon how it is to be connected to an external device. In general, the connector is connected to a main board and is positioned within a body of the electronic device. Exposing a connecting portion of the connector to the outside of the body necessitates overcoming the distance by which the connecting portion is separated from the exterior surface of the body. For this, a conventional electronic device uses a method of using a main board having a two-layered structure.

A connector of a conventional electronic device is described in detail hereinbelow.

FIG. 1 is a perspective view illustrating a first connector 10*a* according to an exemplary embodiment of the prior art.

The first connector 10*a* includes a mold 11*a*, a connection pin 12*a* to connect to an external device, and a fixing portion 13*a* to fix the mold 11*a* to a main board (not shown). The connection pin 12*a* is protruded to one surface of the mold 11*a*, preferably is protruded to a front surface of the mold 11*a* and extends through the front surface. The first connector 10*a* is a battery connector connected to a battery and may be a main connector.

FIG. 2 is a perspective view illustrating a second connector 10*b* according to an exemplary embodiment of the prior art.

The second connector 10*b* may include a mold 11*b* and a connection pin 12*b* to connect to an external device. The connection pin 12*b* is protruded to and extends from one surface of the mold 11*b*, and preferably is protruded to an upper end surface of the mold 11*b*. The second connector 10*b* is a connector connected to an external device including an auxiliary battery and may be an auxiliary connector.

The connection pins 12*a* and 12*b* of the first connector 10*a* and the second connector 10*b* are exposed to another surface from a body of the electronic device. In general, the connection pin 12*a* of the first connector 10*a* is exposed to a surface forming a battery mounting groove of the body to be connected to a battery, and the connection pin 12*b* of the second connector 10*b* is exposed to an outer side surface (e.g., a rear surface) of the body to be connected to the external device.

Generally an electronic device includes a connector that is fixed to a main board installed within a body of an electronic device and separated by a constant distance from the body of the main board. Therefore, when fixing the connector to the main board, the connector has to be large enough to overcome the distance by which the bodies of the electronic device and the main board are separated. If the connector is not sufficient large to overcome that distance, the connection pin cannot be exposed to the outside of the body. As the size of the connector increases, the connector occupies more internal space within the body of the electronic device, which may result in an inefficient use of the internal space.

Nowadays, in order to solve such a problem, as shown in FIG. 3, technology using a two-layered main board 20 has been developed. The two-layered main board 20 facilitates installation of components at opposing surfaces of the main board 20 by forming a wire at the opposing surfaces.

FIG. 3 is a side view illustrating a state in which a first connector and a second connector are installed in a two-layered main board according to an exemplary embodiment of the prior art.

Referring to FIG. 3, a first connector 10*a* is fixed to a lower side surface of the two-layered main board 20. The connection pin 12*a* of the first connector 10*a* is exposed to a surface forming a battery mounting groove of a body 30. The second connector 10*b* is fixed to an upper side surface of the two-layered main board 20. The connection pin 12*b* of the second connector 10*b* may be exposed to an outer side surface of a body adjacent to an upper side surface.

However, when using a two-layered main board, because components are installed in a two-layered structure inside the electronic device, the electronic device has a large thickness to accommodate the components. In addition, a wiring design to connect such components may be complicated, thereby making such devices it is difficult to produce and increasing their production costs.

SUMMARY

In one aspect of the present disclosure, a connector of an electronic device includes a plurality of connection pins to connect different devices to one connector and an electronic device having the connector.

In another aspect of the present disclosure, a connector of an electronic device and an electronic device having the same may enable a connecting portion connected to an extension to be exposed to one surface of the electronic device by the extension extended toward one surface of the electronic device from a mold installed in a main board.

In a further aspect of the present disclosure, a connector of an electronic device may include: a mold fixed on a main board of the electronic device; a first connection pin having a first connecting portion protruded to one surface of the mold; and a second connection pin having a second connecting portion separated from the mold and an extension portion that connects the second connecting portion and the mold.

The first connecting portion may protrude in a direction parallel to one surface of the main board.

The first connection pin may include a main board connection portion electrically connected to the main board.

The main board connection portion may be connected to a power supply module disposed on the main board.

The second connecting portion may be configured to be positioned (e.g., bent) along a connecting direction of the second connecting portion.

The second connecting portion may be configured to be positioned (e.g., bent) in a vertical direction of one surface of the main board.

The extension portion may be extended in a connecting direction of the second connecting portion from one surface of the mold, and extended one end is connected to the second connecting portion.

The extension portion may be configured to form a curved line (e.g., bent).

The second connection pin may include a support portion that is positioned along a circumference of the mold and that fixes the second connection pin to the mold.

The second connection pin may include a protrusion portion positioned (e.g., bent) in the same direction as that of the second connecting portion.

The second connection pin may include a main board connection portion electrically connected to the main board.

The main board connection portion may be connected to at least one module disposed on the main board.

The at least one module may include at least one of a sun light charge module, near field communication (NFC) module, or wireless charge module.

In yet another aspect of the present disclosure, an electronic device may include: a body having an exterior surface; a main board installed within the interior of the body and at least one constituent element is disposed within the interior of the body; and a connector disposed on the main board, wherein the connector includes: a mold fixed on the main board; a first connection pin having a first connecting portion protruded from one surface of the mold; and a second connection pin having a second connecting portion separated from the mold and an extension portion that connects the second connecting portion and the mold.

The second connecting portion may be configured to be positioned (e.g., bent) in a connecting direction of the second connecting portion.

The connecting direction may be a vertical direction of one surface of the main board.

The extension portion may extend in a connecting direction of the second connecting portion from one surface of the mold, and may be connected to the second connecting portion.

The second connection pin may include a support portion that is positioned along a circumference of the mold and that fixes the second connection pin to the mold.

The second connecting portion may include a main board connection portion electrically connected to the main board.

The main board connection portion is electrically connected to at least one of a sun light charge module, near field communication (NFC) module, or wireless charge module disposed on the main board.

These and other aspects of the present disclosure will be more fully described hereinbelow with reference to the accompanying drawings.

BRIEF DESCRIPTION OF THE DRAWINGS

The above features and advantages of the present disclosure will be more apparent from the following detailed description in conjunction with the accompanying drawings, in which.

DETAILED DESCRIPTION

Figure 1:
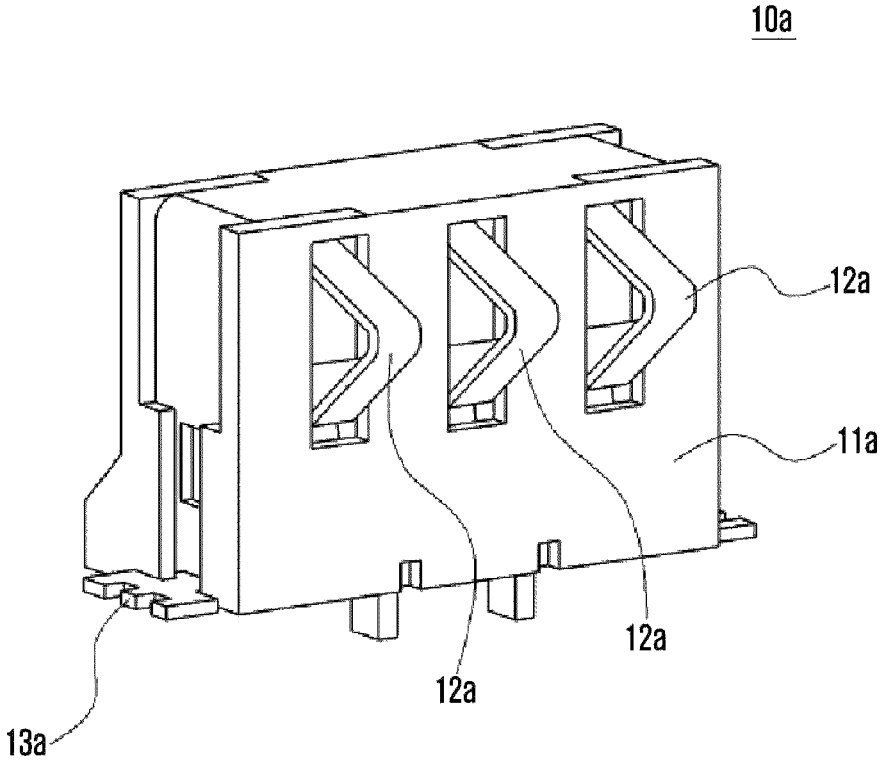
FIG. 1 (PRIOR ART)
FIG. 1 is a perspective view illustrating a first connector according to an exemplary embodiment of the prior art.
Figure 2:
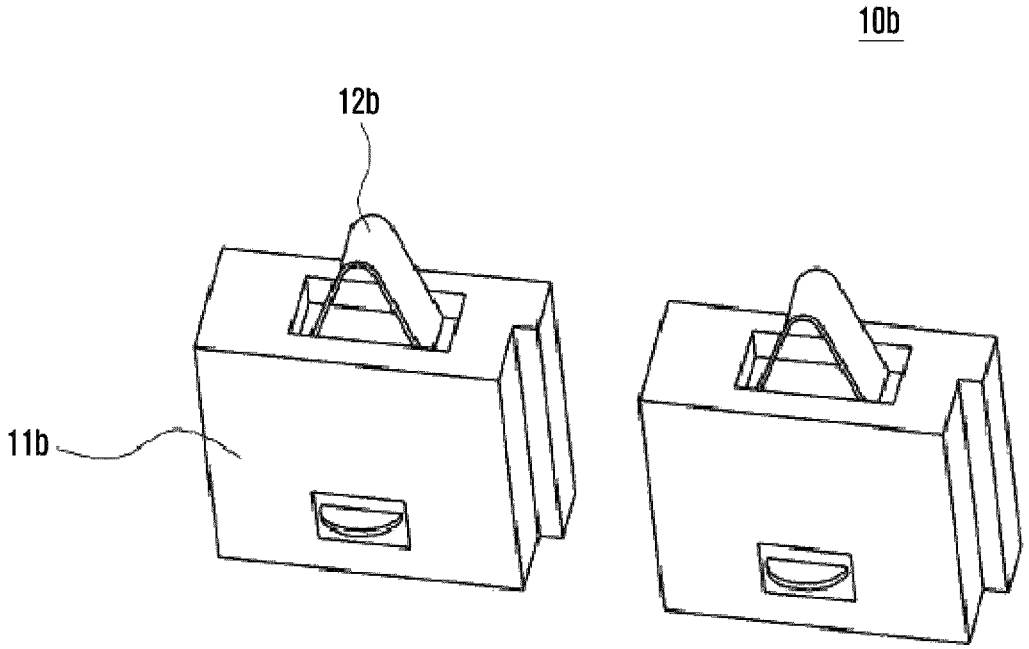
FIG. 2 (PRIOR ART)
FIG. 2 is a perspective view illustrating a second connector according to an exemplary embodiment of the prior art.
Figure 3:
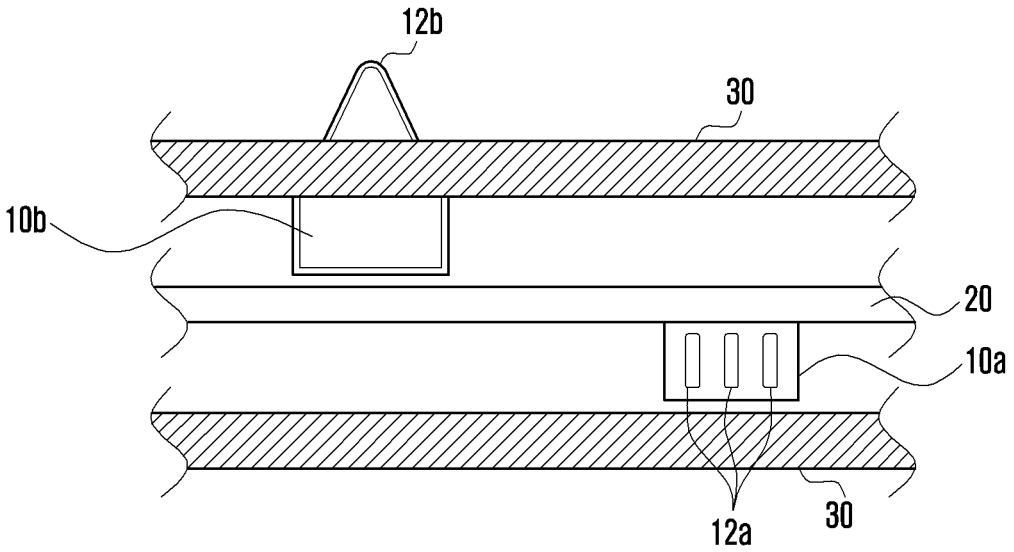
FIG. 3 (PRIOR ART)
FIG. 3 is a side view illustrating a state in which a first connector and a second connector are installed in a two-layered main board according to an exemplary embodiment of the prior art.

Hereinafter, exemplary embodiments of the present disclosure are described in detail with reference to the accompanying drawings. The same reference numbers are used throughout the drawings to refer to the same or like parts. The views in the drawings are schematic views only, and are not intended to be to scale or correctly proportioned. Detailed descriptions of well-known functions and structures incorporated herein may be omitted to avoid obscuring the subject matter of the present disclosure.

Singular forms used here include a plurality of forms unless phrases explicitly represent an opposite meaning. In the specification, the word "include" and variations such as "includes" or "including" should not be understood to always include several constituent elements described in the specification.

The present disclosure relates to an electronic device having a connector and may be applied to entire devices having a connector as well as a general electronic terminal such as, for example, a smart phone, portable terminal, mobile terminal, personal digital assistant (PDA), portable multimedia player (PMP), notepad, WiBro terminal, and tablet personal computer (PC).

Figure 4:
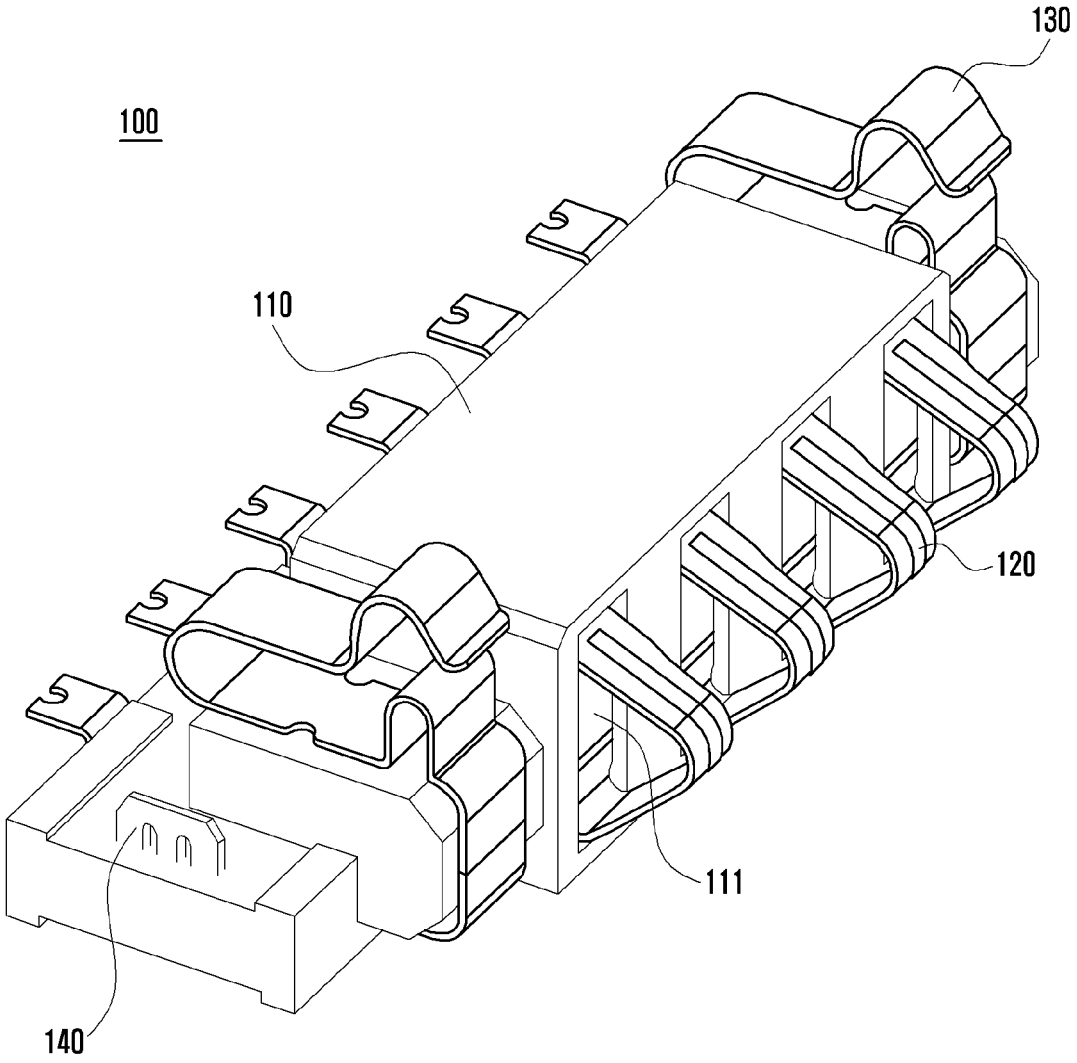
FIG. 4 is a perspective view illustrating a connector according to an exemplary embodiment of the present disclosure.

FIG. 4 is a perspective view illustrating a connector 100 according to an exemplary embodiment of the present disclosure.

Referring to FIG. 4, the connector 100 according to the present exemplary embodiment may include a mold 110, first connection pin 120, second connection pin 130, and fixing portion 140.

Figure 6:
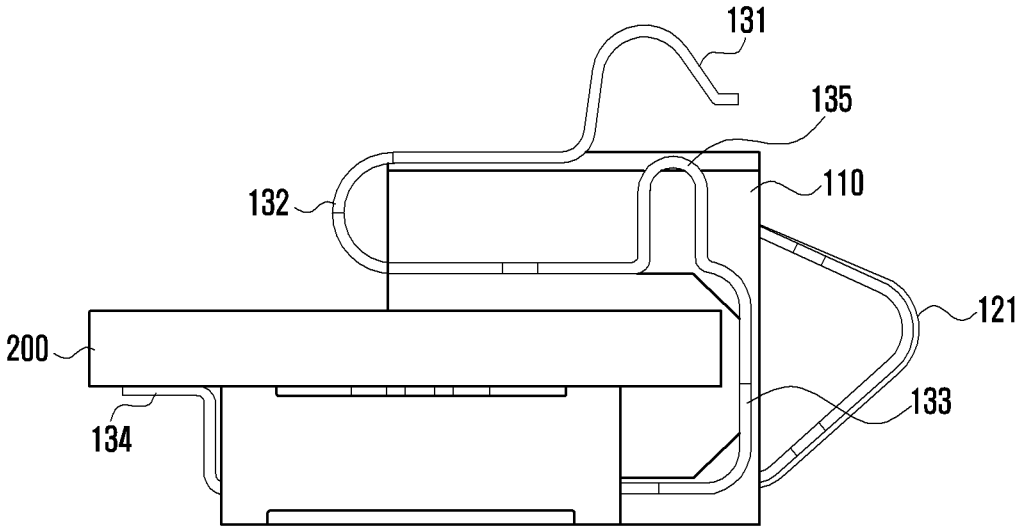
FIG. 6 is a side view illustrating the connector of FIG. 4.
Figure 8:
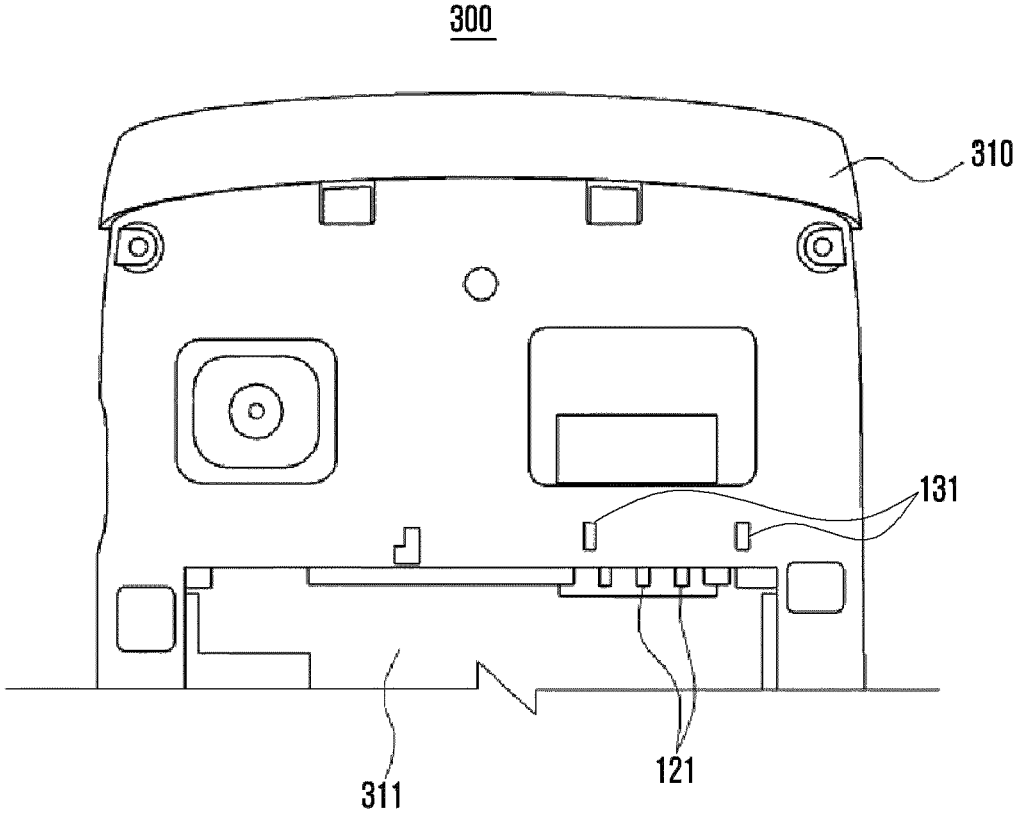
FIG. 8 is a top plan view illustrating an electronic device having a connector according to an exemplary embodiment of the present disclosure.

The mold 110 may be fixed on a main board 200 of an electronic device 300 (FIG. 8). For this, the mold 110 may include at least one fixing portion 140 to be fixed to the main board 200 (FIG. 6). The mold 110 may be made of a synthetic resin material. Further, the mold 110 may have at least one slot 111 through which a portion of at least one of the first connection pin 120 and the second connection pin 130 may protrude.

At least one first connection pin 120 may be provided, and preferably three or four first connection pins 120 may be provided. Both ends of the first connection pin 120 may be supported by the inside of the mold 110, and a central portion between the both ends may be configured (e.g., bent) to form a connecting portion 121 of the first connection pin 120. The connecting portion 121 may extend to one surface of the mold 110 and protrude through the slot 111, i.e., in a connecting direction. Preferably, the connecting portion 121 may extend to a front surface of the mold 110. In an exemplary embodiment of the present disclosure, a direction in which the connecting portion 121 of the first connection pin 120 is protruded may be a direction parallel to the main board 200. One end of the first connection pin 120 may extend to the outside of the connector 100 through another one surface of the mold 110 to form a main board connection portion 122 electrically connected to the main board 200.

In an exemplary embodiment of the present disclosure, the first connection pin 120 may be coupled to a main battery, the connecting portion 121 of the first connection pin 120 is connected to a terminal formed in the battery, and a main board connection portion 122 of the first connection pin 120 may be electrically connected to a power supply module of the main board 200.

At least one second connection pin 130 may be provided, and preferably two second connection pins 130 may be provided.

Figure 5:
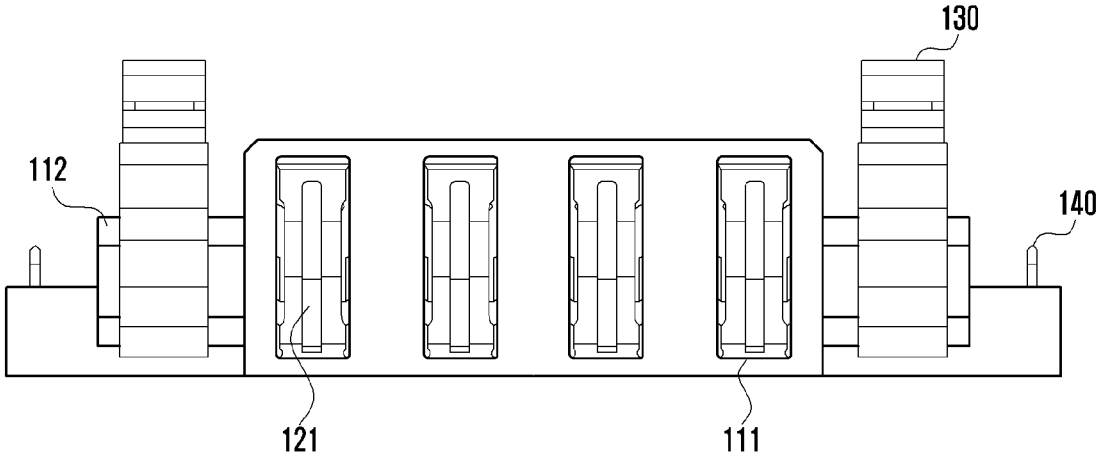
FIG. 5 is a front view illustrating the connector of FIG. 4.

FIG. 5 is a front view illustrating the connector of FIG. 4, and FIG. 6 is a side view illustrating the connector of FIG. 4.

Referring to FIG. 6, one end of the second connection pin 130 may be separated from the mold 110 to form a connecting portion 131 of the second connection pin 130. The connecting portion 131 may be positioned (e.g., bent) in one direction, i.e., a connecting direction. Preferably, the connecting portion 131 may be positioned (e.g., bent) in a direction in which a body of the connector 100 is positioned. In an exemplary embodiment of the present disclosure, a direction in which the connecting portion 131 of the second connection pin 130 may be positioned (e.g., bent) a vertical direction of the main board 200.

The connecting portion 131 may be connected to an extension 132 extended in a connecting direction of the connecting portion 131 from one surface of the mold 110. The extension 132 may approach the connecting portion 131 to a body of the electronic device 300 so that the connecting portion 131 of the second connection pin 130 fixed to the mold 110 may be exposed to the outside of the electronic device 300. The extension 132 may be formed in various lengths and shapes according to a position at which the connecting portion 131 is to be exposed on the body and a position fixed to the mold 110 within the body. Further, the extension 132 may be configured to be positioned (e.g., bent) according to a random direction or the random number of times or in an exemplary embodiment described with reference to FIG. 5, the extension 132 may be bent vertically to the connecting portion 131, preferably is bent toward a rear surface of the mold 110.

The connecting portion 131 may be connected to a support portion 133 that fixes the second connection pin 130 to the mold 110. The support portion 133 may be fixed to the inside or the outside of the mold 110.

Referring to FIG. 5, when the support portion 133 is fixed to the outside of the mold 110, in the mold 110, an ending portion 112 to fix the second connection pin 130 may be formed. The ending portion 112 may be formed in an appropriate height so that the connecting portion 131 of the second connection pin 130 may be exposed to the outside of the body of the electronic device. The support portion 133 is positioned (e.g., bent) along a circumference of the ending portion 112, preferably is positioned (e.g., bent) along a circumference forming a height of the ending portion 112. Accordingly, the connecting portion 131 connected to the support portion 133 may be adjacently formed and may extend in a body direction of the electronic device by a height corresponding to that of the ending portion 112.

Another end of the second connection pin 130 may form a main board connection portion 134 extended to the outside through another one surface of the mold 110 to be electrically connected to the main board 200.

Referring to FIG. 4, the main board connection portion 134 of the second connection pin 130 may extend in the same direction as that of the main board connection portion 134 of the first connection pin 120.

In an exemplary embodiment of the present disclosure, the second connection pin 130 may be coupled to an external device, and the connecting portion 131 of the second connection pin 130 may be connected to a terminal formed in the external device, and the main board connection portion 134 may be coupled to a module, such as, for example, a sun light charge module, a near field communication (NFC) module, and a wireless charge module of the main board 200.

The first connection pin 120 and the second connection pin 130 may be formed to include an elastic spring material. A connecting portion of the first connection pin 120 and the second connection pin 130 is pressed in a constant depth when connecting to an external device. Further, when a connection to an external device is released, the first connection pin 120 and the second connection pin 130 may be returned to an original position by an elastic force of a spring.

Referring to FIG. 6, in order to prevent excessive pressing of the connecting portion 131, the second connection pin 130 may include a protrusion portion 135. The protrusion portion 135 may be positioned adjacent to the connecting portion 131 and may be positioned (e.g., bent) in a connecting direction of the connecting portion 131.

Figure 7:
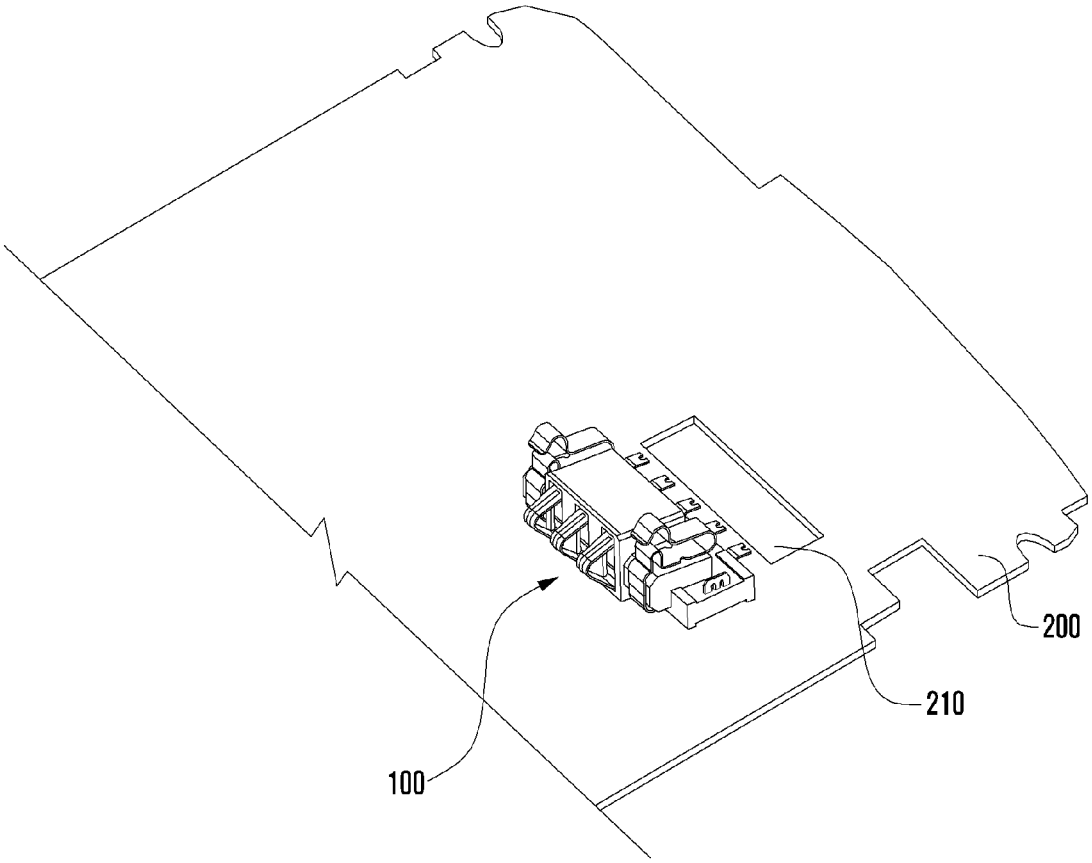
FIG. 7 is a perspective view illustrating a state in which a connector is installed in a main board according to an exemplary embodiment of the present disclosure.

FIG. 7 is a perspective view illustrating a state in which a connector is installed in the main board 200 according to an exemplary embodiment of the present disclosure.

At the main board 200, various constituent elements, circuit devices, and communication circuits to control operation of an electronic device are disposed. For example, at the main board 200, at least one input module, control module, memory, screen output module, sound input/output module, and camera module may be disposed.

In an exemplary embodiment of the present disclosure, the main board 200 may have at least one module 210 for electrical signal exchange, data communication, and power transmission and reception with external devices connected through the second connection pin 130. For example, at least one module 210 may be a sun light charge module, NFC module, and wireless charge module. At least one module 210 may be electrically connected to the main board connection portion 134 of the second connection pin 130, and may be connected to an external device through the second connection pin 130 or through the connecting portion 131 of the second connection pin 130.

FIG. 8 is a top plan view illustrating the electronic device 300 having the connector 100 according to an exemplary embodiment of the present disclosure.

FIG. 8 illustrates a mobile terminal of a bar form as an example of the electronic device 300, but the electronic device 300 may be formed in a folder form or a sliding form to which a rotatable or slidable body may be coupled.

The electronic device 300 may be formed with at least one body 310 in which the main board 200 shown in FIG. 7 may be mounted. The body 310 forms an exterior surface of the electronic device 300. At a rear surface of the body 310, a battery mounting groove 311 may be formed, as shown in FIG. 8. In an exemplary embodiment of the present disclosure, the connecting portion 121 of the first connection pin 120 constituting the connector 100 may be exposed to the outside of a surface forming the battery mounting groove 311. Accordingly, the first connection pin 120 may be connected to a terminal of a battery in which the battery of the electronic device 300 is mounted in the battery mounting groove 311. The connecting portion 131 of the second connection pin 130 constituting the connector 100 may be exposed to the outside in a direction vertical to one surface of the body 310. Thereby, the second connection pin 130 may be connected to a terminal of an external device mounted at one surface of the body 310. The outside device may be, for example an NFC device, sun light charge pad, and wireless charge pad.

The electronic device 300 may include a cover that covers an exposure portion of the second connection pin 130 and the battery mounting groove 311. The cover may include an auxiliary device such as a sun light battery plate, wireless charge battery plate, and NFC communication module. In this case, the cover may include at least one connector that connects the auxiliary device to the outside. The second connection pin 130 may perform a function of electrically connecting the electronic device 300 and the auxiliary device provided in the cover by connecting the connector formed in the cover.

As described above, a connector of an electronic device and an electronic device having the same according to the present disclosure may include an extension extending toward one surface of the electronic device from a mold installed in a main board, and a connecting portion connected to the extension may be exposed through one surface of a body of the electronic device.

Accordingly, a connector of an electronic device and an electronic device having the same according to the present disclosure may include a connecting portion that extends to an outer side surface of a body. Advantageously, such a configuration facilitates use of a two-layered main board or a connector having a relatively large size while efficiently utilizing the space within the device, thereby reducing material costs and enabling the electronic device to have a relatively small size.

Although exemplary embodiments of the present disclosure have been described in detail hereinabove, it should be clearly understood that many variations and modifications of the basic inventive concepts herein described, which may appear to those skilled in the art, will still fall within the spirit and scope of the exemplary embodiments of the present disclosure as defined in the appended claims.

What is claimed is:

1. A connector of an electronic device having a main board, comprising:

a mold fixed on the main board of the electronic device and having a slot formed thereon;

a first connection pin having a first connecting portion protruding through the slot of the mold; and a second connection pin having a second connecting portion separated from the mold and an extension portion connecting the second connecting portion and the mold, wherein the extension portion comprises a lower extension portion and a higher extension portion being extended from the lower extension portion, and the lower extension portion is mounted on and supported by two outer parallel surfaces of the mold, while the higher extension portion is separated from the mold.

2. The connector of claim 1, wherein the first connecting portion protrudes in a direction parallel to one surface of a main board, wherein the one surface is vertical to the outer surface.

3. The connector of claim 1, wherein the first connection pin comprises a main board connection portion electrically connected to the main board.

4. The connector of claim 3, wherein the electronic device includes a power supply module disposed on the main board, and wherein the main board connection portion is connected to the power supply module.

5. The connector of claim 1, wherein the second connecting portion is configured to be bent along a connecting direction of the second connecting portion.

6. The connector of claim 5, wherein the connecting direction is a vertical direction of one surface of the main board, wherein the one surface is parallel to the outer surface.

7. The connector of claim 1, wherein the extension portion extends in a connecting direction of the second connecting portion from the outer surface of the mold, and wherein one extended end of the extension portion is connected to the second connecting portion.

8. The connector of claim 1, wherein the extension portion is configured to form a curved line.

9. The connector of claim 1, wherein the second connection pin comprises a support portion that is positioned along a circumference of the mold and that fixes the second connection pin to the mold.

10. The connector of claim 1, wherein the second connection pin comprises a protrusion portion configured to be bent in a connecting direction of the second connecting portion.

11. The connector of claim 1, wherein the second connection pin comprises a main board connection portion electrically connected to the main board.

12. The connector of claim 11, further comprising at least one module disposed on the main board, wherein the main board connection portion is connected to the at least one module.

13. The connector of claim 12, wherein the at least one module comprises at least one of a sun light charge module, near field communication (NFC) module, and a wireless charge module.

14. An electronic device, comprising:

a body having an exterior surface;

a main board installed within an interior of the body; and at least one constituent element is disposed within the interior of the body; and a connector disposed on the main board, wherein the connector comprises:

a mold fixed on the main board of the electronic device and having a slot formed thereon;

a first connection pin having a first connecting portion protruding through the slot of the mold; and a second connection pin having a second connecting portion separated from the mold and an extension portion that connects the second connecting portion and the mold, wherein the extension portion comprises a lower extension portion and a higher extension portion being extended from the lower extension portion, and the lower extension portion is mounted on and supported by two outer parallel surfaces of the mold, while the higher extension portion is separated from the mold.

15. The electronic device of claim 14, wherein the second connecting portion is configured to be bent in a connecting direction of the second connecting portion.

16. The electronic device of claim 15, wherein the connecting direction is a vertical direction of one surface of the main board, and wherein the one surface is parallel to the outer surface.

17. The electronic device of claim 14, wherein the extension portion extends in a connecting direction of the second connecting portion from the outer surface of the mold, and wherein one extended end of the extension portion is connected to the second connecting portion.

18. The electronic device of claim 14, wherein the second connection pin comprises a support portion that is positioned along a circumference of the mold and that fixes the second connection pin to the mold.

19. The electronic device of claim 14, wherein the second connecting portion comprises a main board connection portion electrically connected to the main board.

20. The electronic device of claim 19, wherein the main board connection portion is electrically connected to at least one of a sun light charge module, near field communication (NFC) module, and a wireless charge module disposed on the main board.

* * * * *